US007170648B2

(12) United States Patent
Pilloud

(10) Patent No.: US 7,170,648 B2
(45) Date of Patent: Jan. 30, 2007

(54) DEVICE FOR SCANNING REGISTER MARKS INTO A POLYCHROME PRINTING MACHINE

(75) Inventor: Francis Pilloud, Chernex (CH)

(73) Assignee: Bobst, S.A. (CH)

( * ) Notice: Subject to any disclaimer, the term of this patent is extended or adjusted under 35 U.S.C. 154(b) by 553 days.

(21) Appl. No.: 10/026,514

(22) Filed: Dec. 24, 2001

(65) Prior Publication Data

US 2002/0080430 A1 Jun. 27, 2002

(30) Foreign Application Priority Data

Dec. 27, 2000 (CH) ..... 2528/00

(51) Int. Cl.
*H04N 1/04* (2006.01)

(52) U.S. Cl. ..... 358/474; 358/482; 358/1.2; 358/1.4; 358/1.9; 358/475; 250/227.24; 250/559.3

(58) Field of Classification Search ..... 358/474, 358/505, 482, 1.2, 1.4, 1.9, 509, 513, 514, 358/515, 475; 250/227.24, 559.3
See application file for complete search history.

(56) References Cited

U.S. PATENT DOCUMENTS

| | | | | |
|---|---|---|---|---|
| 5,215,011 | A | 6/1993 | Monney | |
| 5,329,466 | A | 7/1994 | Monney | |
| 5,747,795 | A * | 5/1998 | Monney | 250/227.24 |
| 5,768,026 | A * | 6/1998 | Kiyomoto et al. | 359/634 |
| 6,657,758 | B1 * | 12/2003 | Garner | 359/196 |

FOREIGN PATENT DOCUMENTS

| | | |
|---|---|---|
| CH | 686501 A5 | 4/1996 |
| CH | 690096 A5 | 4/2000 |
| DE | 3311352 | 3/1984 |
| EP | 0214214 | 9/1986 |
| EP | 0401691 | 12/1990 |
| EP | 0512448 | 11/1992 |
| JP | 1053121 | 3/1989 |
| JP | 05133726 | 5/1993 |
| WO | 8706190 | 10/1987 |

* cited by examiner

*Primary Examiner*—Douglas Q. Tran
*Assistant Examiner*—Negussie Worku
(74) *Attorney, Agent, or Firm*—Ostrolenk, Faber, Gerb & Soffen, LLP

(57) ABSTRACT

Scanning device (1) for register marks (21, 22, 31, 32) printed onto a substrate (2) travelling into a polychrome printing machine. This device comprises at least one light source (3, 4) enlightening, onto the substrate (2), a lighting area (5) crossed by the register marks (21, 22, 31, 32), an optic (6) which allows obtaining onto a photosensitive element (7) the images of said register marks named as a plurality of portions (8) successively scanned with a certain scanning rate, as well as a microprocessor (9) driving the light of the light source (3, 4) and controlling electric pulses issued by pixels (17) of the photosensitive element (7). The source (3, 4) enlightens the lighting area (5) of the substrate (2) with at least one modulation of its color and/or of its intensity during the simultaneous or sequential scanning of at least two register marks. (21, 22, 31, 32).

10 Claims, 2 Drawing Sheets

DEVICE FOR SCANNING REGISTER MARKS INTO A POLYCHROME PRINTING MACHINE

BACKGROUND OF THE INVENTION

The present invention has as an aim of providing a device for scanning register marks into a polychrome printing machine processing a sheet or a web material. This material, or print substrate, usually has an area for printing the image and a printing area for the accuracy control marks, marks usually known under the name of register marks, related to the setting into register of the different printing colors.

Such machines comprise indeed several printing units the ones following the others, each one printing on the substrate, by means of an engraved cylinder or a plate cylinder for example, a same pattern of a different color. For obtaining a perfect final image, it is necessary for all the prints of different colors to be exactly superimposed. The register control of these prints is achieved by means of register marks printed by each printing cylinder within the area intended for quality control marks, thus usually in the margin of the worked substrate. Thanks to a scanning device, these marks allow to determine the misregister of each color compared to the color of the first printing unit, usually used as reference. To compensate these shifts, a correcting order is issued and works either on the path of the printing substrate, or on the location of the corresponding printing cylinders.

Many known devices, such as those described in documents CH690096, EP0401691 and U.S. Pat. No. 5,747,795, allow to register and scan these marks printed on sheet or web elements traveling in front of a light source. However these devices can usually scan only one register mark at the same time, which means that a polychrome print i.e. requires as many scanning devices as there are marks, that is to say colors into the print.

Several devices, such as the one described in the document EP0214214, allow to take a picture of a whole range of marks by means of a video camera like a CCD one, then to operate on this image an analog-to-digital conversion, to center this digitized image on a scanning gate and to determine variations compared to reference marks. A white light source ensures a sufficient lighting of the substrate filmed by the video camera. This light source can result from a stroboscope which, thanks to its repeated flashes, allows to take fixed images of the substrate travelling at high speed.

Other devices, such as the one described in document EP0512448, propose to solve problems of selecting register marks which have the characteristic to be slightly contrasted with regard to the background color of the substrate on which they are printed; usually when the printed colors fade to paleness such as it is the case for example with pastel yellow, cream or light blue. The above mentioned device allows to scan only one mark at a time, the latter being illuminated by a white colored light source. The light reflected by this mark is separated by two channels made of optical fibers at the end of which two filters of different colors are arranged and located in front of two photosensitive units. Each photosensitive unit is especially sensitive within a frequency range of a distinct color and produces an electric signal at the time of the register mark travelling. The mark scanning is achieved by means of a comparting/selecting device which selects, among the generated electric pulses, the more representative one for the color mark.

When the aim is the simultaneous scanning of several register marks by means of the same device, the lighting of these marks becomes an increasingly significant component, particularly when a single, white or monochromic light source cannot make these marks more visible. Indeed, according to the color of the printed marks, the latter seem likely, under such a lighting, not to be sufficiently contrasted and to appear as invisible or, on the contrary, to generate dazzling or reflecting problems in the presence of specular colors such as gold color marks for example.

In the case used colors are intense and clearly allow to distinguish the printed marks by well shaped contours, the simultaneous scanning, by a same device, of several marks equipped with such colors would not cause in fact a particular problem; the latter being easily recognizable under a single white light as shown for the device of document CH686501.

Hence, in a whole third of cases, the printed colors are not so distinguishable from each other and require specific lightings in order to improve the real contrast either between themselves or in accordance with the background color of the printed pattern. Thus, a mark with a prevalence of green, purple or orange will appear all the more contrasted when its lighting color is full of complementary color, that is to say respectively in red, yellow or blue for the case.

In order to guarantee the reliability and the performance of the scanning systems, it is also obvious to make these distinctive marks quite apparent. Indeed, at the time of the start up of the printing machine, the first stage comprises the searching of the initially unknown positions for each register mark. This process is easier when each of the marks is illuminated by a source of appropriate color. In the same way, when these marks travel at significant speeds, i.e. up to 20 m/s, one will easily note that it is also obvious, even necessary, that these marks can be scanned without any possible doubt.

Currently, the simultaneous scanning of two or three register marks of slightly contrasted colors must be carried out by as many scanning devices; each one being equipped with a specific lighting according to the color mark for which it is intended. However, such a plurality of devices increases the printing machine installation and maintenance costs, requires more space and includes a scanning system more difficult to deal with in its whole embodiment, while proportionally increasing the risk of possible breakdowns.

SUMMARY OF THE INVENTION

The aim of the present invention is to overcome these disadvantages while offering a compact scanning device which allows, with a minimum of one scanning head, the simultaneous scanning of several register marks. Generally, several marks each require a scanning device equipped with a special lighting so as to present a sufficient contrast needed for their scanning. The device according to the invention is advantageously able to scan some shifts between each color prints after simultaneous scanning of a reference mark and of one or more register marks by only scanning head.

This aim is reached thanks to a scanning head equipped with one or more lines of photosensitive elements, generally identical, and light issued from a light source for which one might alternatively modify the color and/or the intensity. The use of a plurality of different elements sensitive to particular colors related to the ones used into the printing, has a same action and can be considered as being another embodiment of the device.

During their travelling under said scanning head, the register marks are registered by the photosensitive elements and scanned by sweeping in a multiplicity of narrow independent cuts, which are successively laid out the ones following the others and rebuild, in a striated way, the images of scanned marks. The modulation of the light source generates an alternation of colors and/or intensity and allows to obtain a lighting colors cycle arranged line by line during the image sweeping, or lines groups by lines groups, even image by image.

The simultaneous or nearly simultaneous scanning of these marks by this device depends neither on these marks' shapes, nor on their size, nor on their layout related to the others. Thus, the scanning of concentric and slightly contrasted register marks can be simultaneously scanned without any problem with the device of the invention, which will alternatively modulate its lighting color according to scanned marks in order to make them alternatively quite visible.

Appropriately, it is possible, for the already known shape of the marks to scan, to vary the alternation lighting periodicity in time or to vary the extension of the areas enlightened one by one. Hence, it could be useful to determine and set various lighting sequences being specifically convenient to the geometry of a certain kind of selected marks. Acting as an example, a continuation of such sequences could comprise the scanning of a group of several successive lines illuminated under a same color, then the scanning of a succession of lines alternatively projected one by one, in one color then in another, before getting back to the scanning of a group of several lines under the same lighting.

When the register marks are of the same color, the proposed device would not be disturbed at all by a lack of alternation in the lighting colors. According to the invention, said device is moreover not limited by the possible amount of lighting colors. As previously suggested, associating both or replacing the alternation of the lighting colors, this lighting intensity could also be modulated and used for scanning the requested marks. Usefully, the use of filters generating different colors from a white light for example, could also replace the variety of the light sources and thus without adding a new characteristic. Lastly, according to various possible embodiments, the amount of lines of photosensitive elements does not enhance at all the possible applications of the device, as above described.

BRIEF DESCRIPTION OF THE DRAWINGS

The invention will be better understood by studying a mode of realization selected as a by no means restrictive example an illustrated by the attached figures, in which.

DESCRIPTION OF A PREFERRED EMBODIMENT

Figure 1:
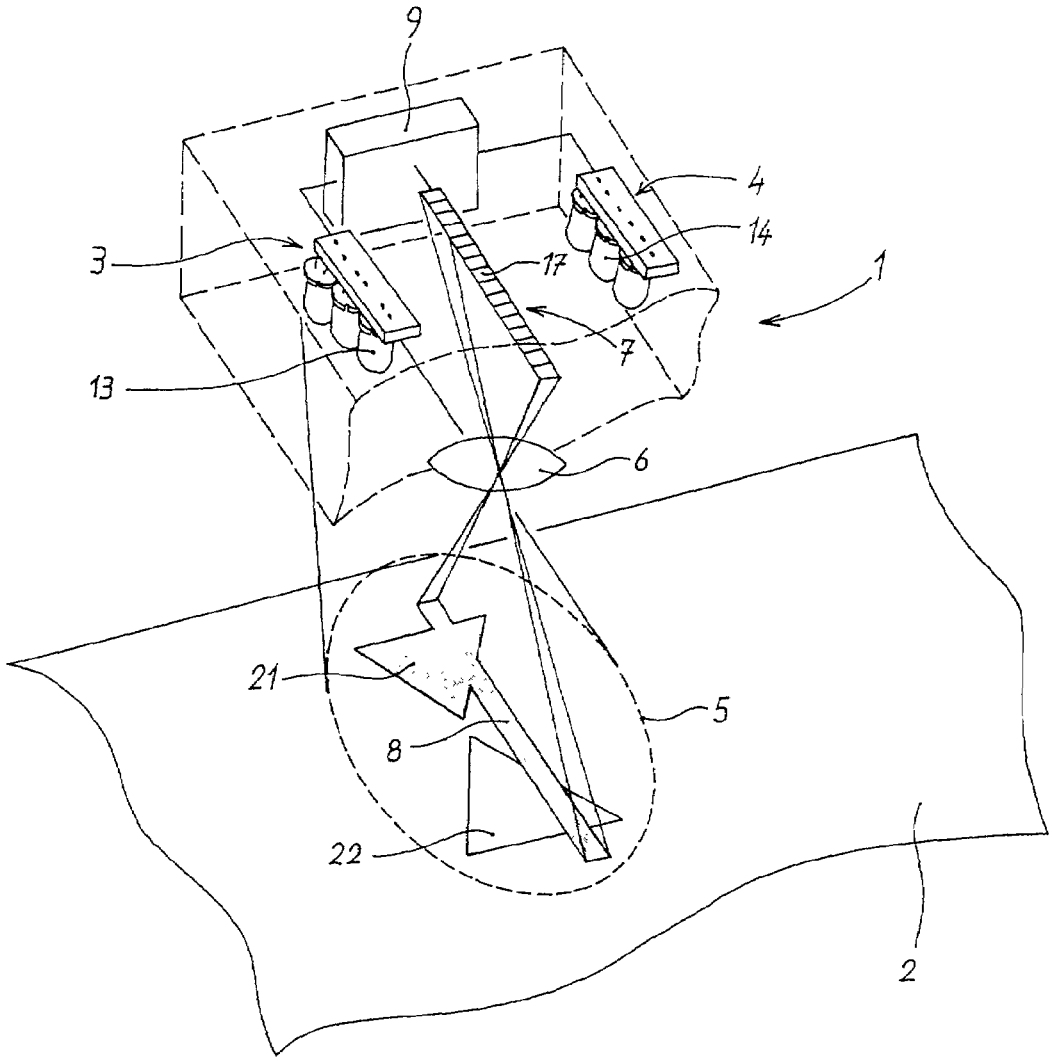
FIG. 1 is a schematic perspective view of said scanning device laid out upon a substrate printed with register marks.

FIG. 1 is a schematic perspective view of device 1 of the invention. This device is arranged upon a substrate 2, traveling into a polychrome printing machine, so that it can easily scan the register marks 21, 22 printed on this substrate. The scanning device 1 comprises a box, line-dotted and partially represented, in which there are at least two light sources 3, 4, which allow both sources to project alternatively on the substrate 2 a lighting area 5 overlapping at least the area involved with the register marks 21, 22. Each source of light 3, 4 is usually composed of one or more light-emitting diodes 13, 14 such as the ones illustrated as an example in FIG. 1. The scanning device 1 also includes an optical device 6 allowing to project, on at least one photosensitive element 7, the image of a portion 8 of the substrate surface 2 which is illuminated in the area 5. Scanning portion 8 corresponds to an area the size of which is mainly selected to be related to the size of the register marks and to the contents of the operations plan of the scanning device. The latter defines in particular the image resolution of the aforesaid scanned register marks, as well as the run speed of these images by the scanning device according to the travel speed of substrate 2. The photosensitive element 7 can be a CCD sensor made up of a great number of pixels 17 generating electric pulses and forming, according to their amount and their location, one or more photosensitive areas located side by side. In FIG. 1, only one area of pixels 17 constitutes the photosensitive element 7 as illustrated. The latter is connected, like the scanning sources 3 and 4, to a microprocessor 9 which allows in particular to control the lighting of these sources according to a registered mode and to deal with the pulses generated by each pixel 17.

The operating way of this device is intended to scan the register marks 21, 22 in their entirety by successively registering adjacent images portions 8, alternatively illuminated in one color and in another one, thanks to the light sources 3, 4. Each portion 8 of register marks is preferably scanned only once under the light of one of the light sources, the latter having lighting sequences controlled in time and duration according to the selected more into the microprocessor 9. The final image of the register marks obtained through this device will be easily recomposed by collecting successively all scanned portions 8 in the same order as the one previously defined at the register time by the traveling of substrate 2. Once recomposed, this image, or the included data, will then be used to define the possible shifts between the colors of the various prints during the operation of setting into register of the corresponding printing cylinders.

Figure 2:
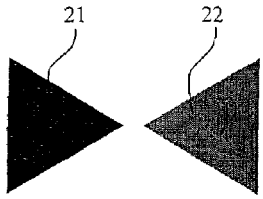
FIG. 2 is a strongly increased view of an example of a pair of register marks printed on a substrate by a polychrome machine.
Figure 3:
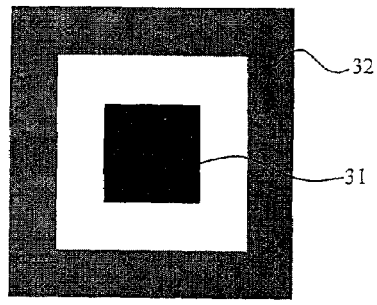
FIG. 3 is a strongly increased view of an example of a pair of concentric register marks as printed on a substrate by a polychrome machine.

FIG. 2 and 3 show both examples of two pairs of register marks 21, 22 and 31, 32 such as they should appear on the substrate 2 after it was printed by a polychrome machine. On these illustrations, the size of these marks is strongly increased; each one involves indeed only an area of a few square millimeters. The register marks of FIG. 2 are related to those illustrated on FIG. 1, but it goes without saying that other register marks, i.e. the ones of FIG. 3, could also be illustrated here. Each coupled mark is of a different color; thus the color of mark 21 or 31 is not the same as the one of mark 22, respectively 32. As shown here, the triangular shaped marks 21 and 22 are exactly opposed at their tops and are thus perfectly in register one related to the other one, as well as the marks 31 and 32 which are perfectly concentric. In order to be able to measure possible shifts in the relative locations of two marks of a same pair, the latter are scanned by the scanning device 1 of the invention. Being of different color, often pale and lightly contrasted, and although simultaneously scanned, each one of these register marks needs to be enlightened by a complementary color light in order to be quite visible. This allows to improve the contrast and to guarantee that it is correctly scanned by the photosensitive element 7. To this end, the scanning device according to the invention fully overcomes these needs thanks to the alternate lighting illustrated on FIGS. 4 and 5 on the register marks of related FIGS. 2 and 3.

Figure 4:
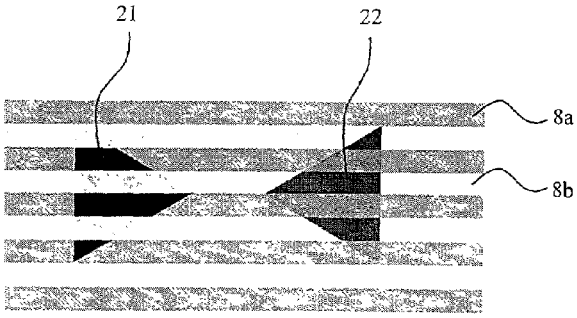
FIGS. 4 and 5, are views of register marks of respective FIGS. 2 and 3 as appearing under lighting areas, in two different illustrative scanning modes, during their simultaneous scanning by the device of the invention.

FIG. 4 shows a plan view of an example of the lighting of scanning device 1 applied to the triangular register marks 21, 22. These register marks can then be clearly visible due to the succession of portions 8, or scanning sections, issued from the device 1. The latter alternatively appear in one color and in another forming narrow areas 8*a*, 8*b* of same size. These colors relate to those of the different light sources 3, 4 which are selected according to the colors of the scanned register marks. Thus, the areas 8*a*, 8*b* are each one of a color which shows a strong contrast with the color of the register marks 21, 22 respectively used. Under this streaked lighting, it is then possible to obviously highlight the borders of the two register marks simultaneously scanned. The borders of each one of these marks appear like a line in stopped feature which easily allows a whole reconstitution of the mark shape and a perfect scanning of the latter during the register operation of the printing cylinders.

Figure 5:
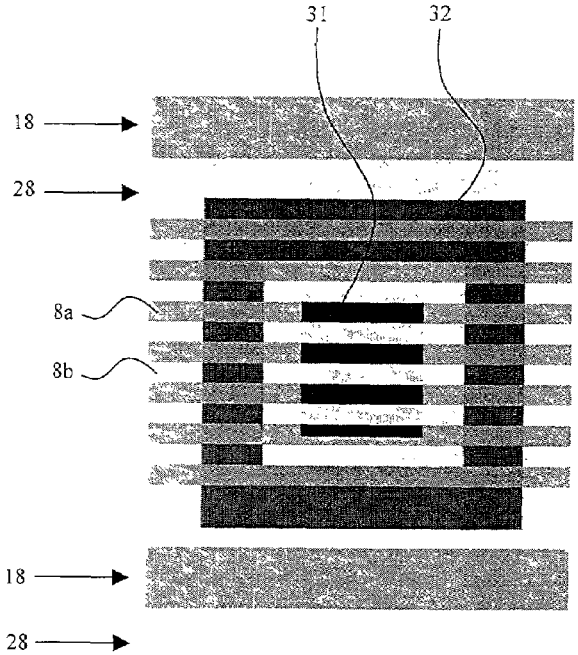

FIG. 5 shows a reconstitution of the image of the concentric register marks of FIG. 3 from portions 8 of images scanned by device 1 in a different lighting mode than the one previously used. On this FIG., one easily detects the various lighting sequences constituting the selected lighting mode. The first sequence is performed by an alternation of a group 18 of three narrow contiguous areas 8*a* with a group 28 of three narrow contiguous areas 8*b* of another color. This succession of alternations is followed, in the central part of the register mark 32, by a second sequence of a succession of alternations of the areas 8*a* and 8*b* selected one by one, before entering again the first sequence issued from the alternations of groups 18 and 28. One can see, that, according to the shape and/or the size of a register mark, one can advantageously vary the alternation lighting frequency, either increasing either reducing the lighting sequence of light sources 3, 4, or opening a diaphragm at the level of the optic 6 so that the surface of portions 8 of images changes proportionally.

When the simultaneously scanned register marks are of identical or slightly similar colors, the scanning device can of course obviate the alternation of the lighting colors and illuminate said marks with a light of only one color during their whole scanning time. One will also note, that when needed, lighting intensity changes can easily replace colors alternations without modifying the scanning way used by the device. It is also obvious that the amount of register marks being simultaneously scanned by the device is evidently not limited. One needs only to adapt the amount of light sources of the different colors of device 1, without excluding however all the possible colors combinations issued for example when a blue light source and a yellow light source are actuated at the same time so as to obtain a area 5 enlightened by a green light on the printed substrate. Although belonging to the same units which constitute sources 3 and 4, it is obvious that the luminous diodes 13, 14 could also produce each one a light of a different color. Moreover, one will also note that the emitted wave lengths by said light sources 3, 4 are evidently not limited to a range comprised in the visible field. Lastly, one could consider that the pixels 17, which constitute in great amount the photosensitive element 7, can have different sensibilities the ones compared to the others related to the waves lengths they get. Hence for example, some pixels 17 could be more particularly sensitive to the orange-red colors whereas others would be rather receptive to the blue-green or yellow colors. To analyze the scanned image, it would be necessary for example to use the pixels of adequate colors to get the marks of different colors. This option would allow to replace the diversity of the colored light sources 3, 4 while keeping only one lighting system slightly similar to the sunlight for example, or at the contrary, it would allow to increase the properties of the scanning device so that a larger colors range can be read.

Many embodiments can still improve the object of the invention within the scope of the claims.

The invention claimed is:

1. A scanning device for scanning register marks printed on a substrate, the device comprising;

at least one light source illuminating a lighting area on the substrate, the lighting area being an area on the substrate crossed by the register marks; the at least one light source that illuminates the substrate at the lighting area includes means for effecting at least one modulation of at least one of intensity and color of the illuminating light during simultaneous or sequential scanning of at least two of the register marks;

a photosensitive element comprised of a plurality of pixels for receiving traveling images of the register marks wherein the traveling images are projected on a photosensitive element having a plurality of scanning portions that are successively scanned according to a predetermined scanning rate and the pixels produce electric pulses;

a microprocessor connected with the at least one light source for controlling the lighting and comprising partly the means for effecting at least one modulation of the light source and for controlling the electric pulses produced by the pixels.

2. The scanning device of claim 1, further comprising an optic disposed between the lighting area and the photosensitive element for directing light reflected from the lighting area to the photosensitive element.

3. The device of claim 1, wherein the microprocessor is operable for causing the modulations of the illumination of the lighting area to be performed in synchronism with the scanning rate of each scanning portion of images.

4. The device of claim 1, wherein the microprocessor is operable for causing the number of modulations per unit time to be the same as the number of scanning portions of images scanned at the same time.

5. The device of claim 1, wherein the microprocessor operates the light source in continuation of different modulations, and the lighting area is subject to illumination variations according to successive repetitions of at least one lighting cycle programmed and controlled by the microprocessor.

6. The device of claim 5, wherein the microprocessor is adapted for establishing that during a lighting cycle, the amount of either different colors and intensity applied to the lighting area are proportional to the number of register marks of different colors that are simultaneously scanned.

7. The device of claim 5, further comprising the light source supply for each color of the register marks supplies at least one of a light of the wave length ranging between 380 nm and 780 nm and an intensity between 5% and 100% of the maximum intensity for improving the contrast of the register marks compared to the substrate at the lighting area.

8. The device of claim 1, wherein the photosensitive element comprises a plurality of pixels which are sensitive to at least one wave length of at least one printed color of the printed register marks.

9. The device of claim 1, wherein the image of the register marks is reconstituted by the successive assembling of said scanning portions scanned in the order of their acquisition during the traveling of the substrate.

10. The device of claim 1, wherein the scanning portions are of oblong shape and are sized according to the register marks dimensions.

* * * * *